United States Patent [19]

Merkle

[11] 4,424,756

[45] Jan. 10, 1984

[54] SUSPENDED ROOF CONSTRUCTION FOR INDUSTRIAL FURNACES

[75] Inventor: Frank P. Merkle, Hanover, Ill.

[73] Assignee: Merkle Engineers, Inc., Galena, Ill.

[21] Appl. No.: 344,515

[22] Filed: Feb. 1, 1982

[51] Int. Cl.[3] ..... F23M 5/06

[52] U.S. Cl. ..... 110/332; 110/338; 110/339; 52/632; 52/485

[58] Field of Search ..... 110/338, 339, 331, 332; 432/251, 252, 247, 248; 52/761, 632, 485

[56] References Cited

U.S. PATENT DOCUMENTS

| | | | |
|---|---|---|---|
| 1,173,862 | 2/1916 | Reilly | 110/332 |
| 1,402,482 | 1/1922 | Davis | 110/339 |
| 1,563,248 | 11/1925 | Burroughs | 110/332 |
| 2,155,165 | 4/1939 | Hener | 110/332 |
| 2,840,017 | 6/1958 | Wolf | 110/339 |
| 2,982,237 | 5/1961 | Copeland et al. | 110/339 |
| 3,400,672 | 9/1968 | Dickson | 110/332 |
| 3,824,936 | 7/1974 | Merkle, Jr. | 110/339 |
| 3,900,182 | 8/1975 | Berman et al. | 52/632 |
| 4,073,243 | 2/1978 | Merkle, Jr. | 110/338 |
| 4,248,024 | 2/1981 | Dahlstrom | 52/632 |

FOREIGN PATENT DOCUMENTS

| | | | |
|---|---|---|---|
| 1152718 | 8/1963 | Fed. Rep. of Germany | 110/339 |

*Primary Examiner*—Henry C. Yuen

*Attorney, Agent, or Firm*—Thomas W. Speckman

[57] ABSTRACT

A suspended roof construction for industrial furnaces is disclosed having carrier bricks of generally rectangular configuration with a hanger recess in one side and shoulder means extending from the upper portion of sides adjacent the hanger recess for support of filler bricks. Thus, a single hanger suspends two carrier bricks which in turn support four filler bricks. Such assemblies of bricks may be fabricated into panel units which provide telescoping tubes on at least one end of hanger tubes for suspension of end bricks between adjacent panel modules. The telescoping tubes may be retracted, the panel unit lowered into place between the structural frame of the furnace roof, the telescoping tubes extended and filler bricks hung from cross bars at each end of the panel unit to fill the spaces between adjacent panels. The suspended roof construction of this invention provides a substantially flat cold surface for easy cleaning and modular panel units which may be more easily fabricated, maintained and repaired.

19 Claims, 6 Drawing Figures

FIG. 4
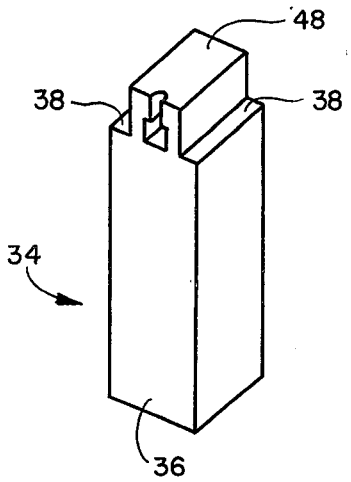
FIG. 5
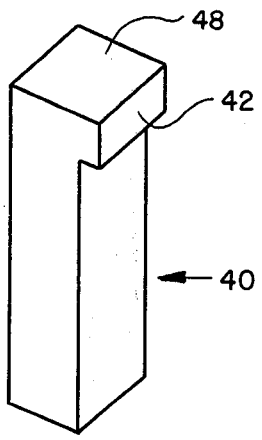
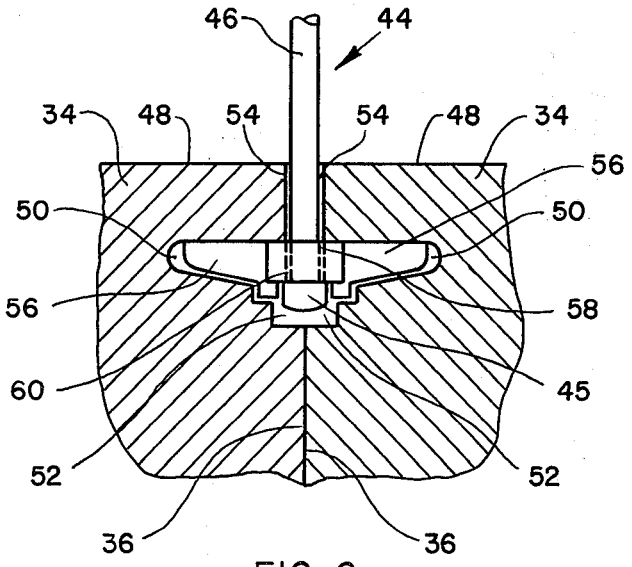
FIG. 6

SUSPENDED ROOF CONSTRUCTION FOR INDUSTRIAL FURNACES

BACKGROUND OF THE INVENTION

This invention relates to a suspended roof construction for industrial furnaces, and more particularly to a refractory roof having a generally flat planar cold face surface which permits easy cleaning. The roof construction of this invention may be preassembled exterior to the furnace in panels which may be lowered between spaced support structures and extended beneath the structures after installation. The roof construction provides easy replacement of entire sections of the suspended roof.

The suspension of refractory bricks in the roof construction of high temperature industrial furnaces is disclosed in U.S. Pat. Nos. 3,824,936 and 4,073,243 which are incorporated herein by reference in their entirety. While the constructions shown in these patents have been generally successful in commercial practice, they are not as easy to clean as desired. Prior art suspended roof designs have not provided roof structures as easy to construct or as easy to repair as desired.

U.S. Pat. No. 3,824,936 describes a roof construction wherein a plurality of basic refractory brick assembly units depend downwardly from hangers which are suspended from a suitable frame. Each assembly unit has a carrier brick having a reduced head portion and a body portion. The reduced head portion is provided with a hole through which an elongated rod extends holding adjacent carrier bricks. The elongated rod is hung on the hangers which extend between the reduced head portions of adjacent carrier bricks. Two filler bricks may be supported by each carrier brick. This construction results in recesses and unevenness on the top surface, or cold face, which is difficult to clean, requires removal of relatively large sections for repair, and requires a horizontal hanger rod through each carrier brick which in turn supports two filler bricks in addition to vertical hanger rods.

In the roof construction shown in U.S. Pat. No. 4,073,243, refractory bricks are suspended from hanger rods which are secured in recesses in one side of the bricks. One hanger rod is required for each pair of bricks, which is undesirable because each rod is an obstacle to cleaning.

There is a need for a suspended roof construction for high temperature furnaces which may be easily constructed and repaired and provides a substantially flat, unobstructed, easy cleaning cold surface.

It is desirable to assemble refractory bricks in panel units before installation in the furnace. When replacement of a section of the furnace roof is required, the panel may be removed and repaired away from the furnace and replaced. It is desirable to remove and replace the panels from the cold side of the roof, so that the furnace need not be completely shut down to effect the repairs.

The furnace roof panels are generally suspended from support means which are secured to a support frame, such as I-beams. The roof panels must be shorter than the space between adjacent members of the support frame so that they may be lowered between the frame members for installation, and raised between the frame members for removal and repair. However, such roof panels do not fill the area of the roof construction below the support frame and the areas between adjacent roof panels must be filled with bricks which must be suspended from above.

Accordingly, an object of the present invention is to provide an improved refractory suspended roof construction for high temperature industrial furnaces which affords easier construction and reduced maintenance as compared to present suspended refractory roofs.

Another object of this invention is to provide a suspended roof construction for high temperature furnaces having a substantially planar, continuous cold face surface which permits the surface to be easily cleaned.

Still another object of this invention is to provide a suspended roof construction for industrial furnaces which is easy to repair.

Yet another object of this invention is to provide a suspended roof construction for industrial furnaces which has multiple roof panels, each of which may be easily lowered or raised between adjacent support frame members and provide means for suspending bricks in the spaces between adjacent roof panels.

It is another object of this invention to provide roof panels for suspended refractory roof construction which have telescoping extension hanger supports for suspending bricks in spaces between adjacent roof panels.

SUMMARY OF THE INVENTION

In accordance with one embodiment of this invention, a suspended roof construction for a high temperature furnace has at least one panel of roof assembly units suspended from a structural support frame by suspension means. The panel may be lowered between two spaced support frame members to desired position. Spaced hanger tubes from which carrier brick hangers suspend the bricks are suspended from the support frame by a suspension means. When in place, the hanger tubes have telescoping extension hangers which may be extended beneath the spaced support frame members for suspension of end bricks from the extension hangers to complete the roof construction. Each of the roof assembly units has two refractory carrier bricks of a generally rectangular configuration, each having a first and third opposing side and a second and fourth opposing side. The first side of one of the carrier bricks is adjacent to and in communication with the first side of the second carrier brick. In addition, the carrier bricks have shoulder means extending from the upper portion of at least one of the second and fourth sides. A hanger in engagement with the adjacent first sides of adjacent carrier bricks suspends them from the hanger tube. At least one refractory filler brick of a generally rectangular configuration having a supporting lug extending from the upper portion of one face thereof engages the shoulder means extending from one side of a carrier brick. Thus, a single hanger suspends two carrier bricks each of which support two filler bricks and thereby six interior bricks are maintained in place by each hanger. The top surfaces of the carrier bricks and the filler bricks are in a substantially flat, common plane.

BRIEF DESCRIPTION OF THE DRAWINGS

The above and other advantages and object of the invention will become more apparent to one skilled in the art upon reading the following disclosure when taken with the drawings showing certain preferred embodiments in which:

FIG. 4 is a perspective view of a carrier brick of the roof assembly unit shown in FIGS. 1-3;

FIG. 5 is a perspective view of a filler brick of the roof assembly unit shown in FIGS. 1-3; and FIG. 6 is a partial sectional view showing a hanger in engagement with refractory carrier bricks as shown in FIGS. 1-3.

DESCRIPTION OF THE PREFERRED EMBODIMENTS

Figure 2:
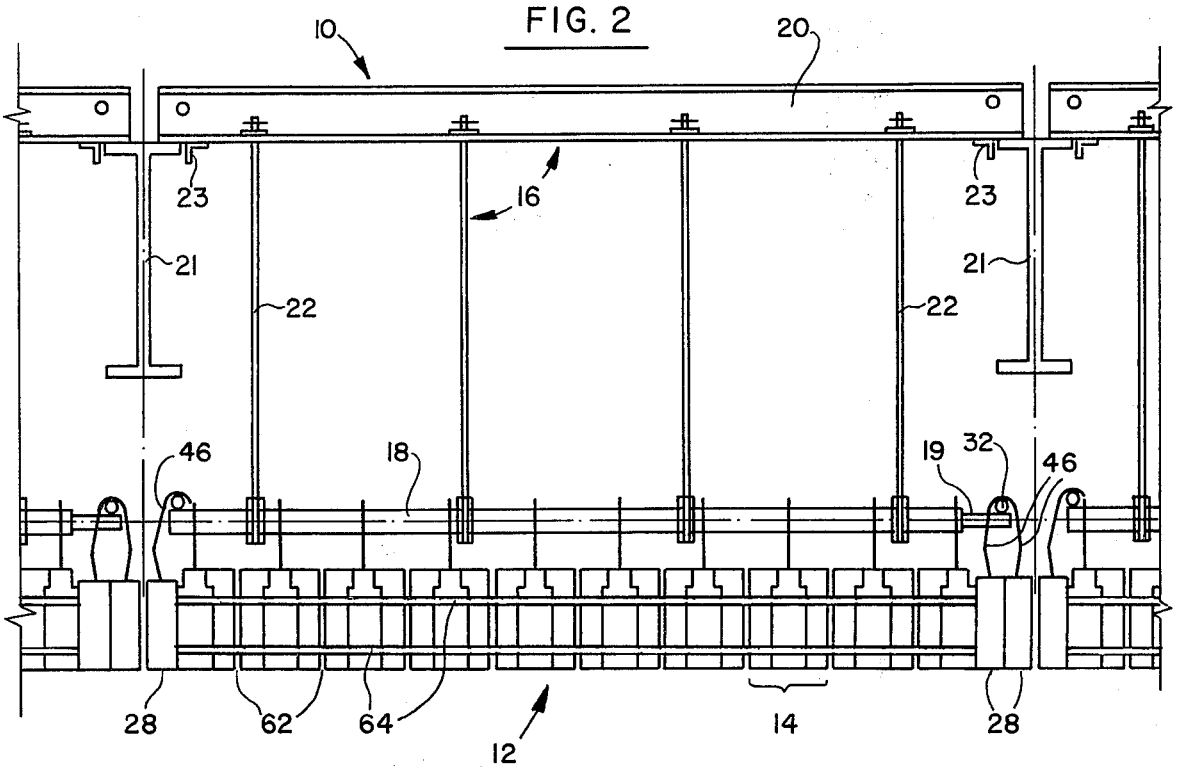
FIG. 2 is an elevation view of the roof construction of FIG. 1 suspended in place from the support frames with end bricks suspended from extension hangers.

Referring to the figures, suspended roof construction module 10 for a high temperature furnace comprises at least one panel 12 of roof assembly units 14 suspended by suspension means 16 from structural support frame 21. Suspension means 16 includes cross beam 20 and suspension wires or rods 22 suspending hanger tubes 18. Any suitable configuration or design for suspension means 16 may be used in the suspended roof construction of this invention so long as it provides suspension of hanger tubes 18 from structural support frame 21. Hanger tubes 18 have a telescoping hanger end 19 on at least one end which may be extended after installation, as shown in FIG. 2.

Figure 1:
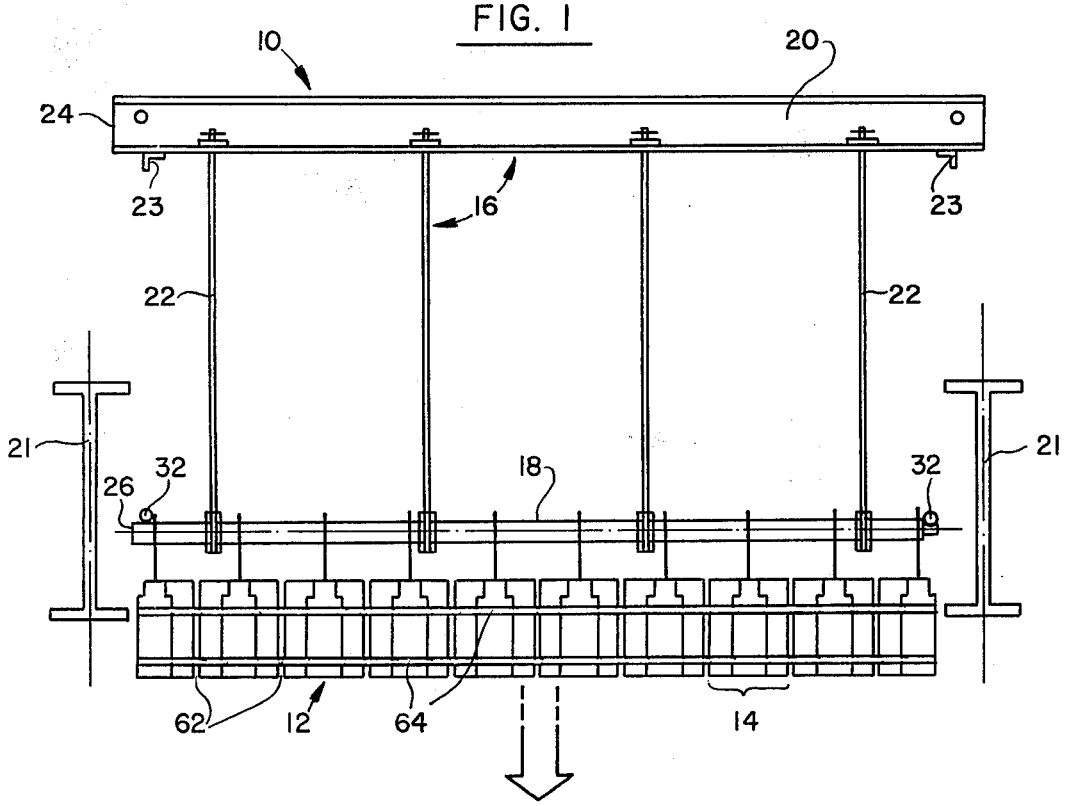
FIG. 1 is an elevation view of one embodiment of roof construction of this invention showing a roof assembly unit being lowered between two spaced support frames.

The entire module 10 beneath cross beam 20 with retracted hanger end 19 may be lowered between two spaced structural support frame beams 21. Hanger tubes 18 may be offset, as shown in FIGS. 1 and 2, toward end 24 of cross beam 20 by an amount of about the same as the projection of the flanges of I beam 21 from its web. In such case, when panel 12 with hanger tubes 18 is lowered beneath structural support frame 21, cross beam 20 may be shifted, to the left as shown in FIGS. 1 and 2, and centered upon structural support frame 21, moving end 26 of hanger tube 18 partially beneath structural support frame 21. This is particularly suitable when telescoping hanger 19 is located at only one end of hanger tube 18. It is apparent that hanger tubes 18 may be centered with respect to cross beam 20 and telescoping hangers 19 may be extended from each end of hanger tube 18. Cross beam 20 may be secured to structural frame 21, if desired. Guides 23 are useful to center cross beam 20 with respect to structural frame 21. End bricks 28 may be suspended from cross bars 32 on fixed end 26 and telescoping hanger 19 by hanger rods 46 after panel 12 is lowered into place and telescoping hanger 19 is extended as shown in FIG. 2. End bricks 28 substantially fill the area between adjacent panels 12 beneath structural support frame 21.

Entire panel 12 may be easily removed by removing end bricks 28, retracting telescoping hanger end 19, and raising suspension means 16 and panel 12. In this manner, replacement or repair may be made to module sections of refractory bricks and metallic hangers from the outside of the furnace, without completely shutting down the furnace.

Figure 3:
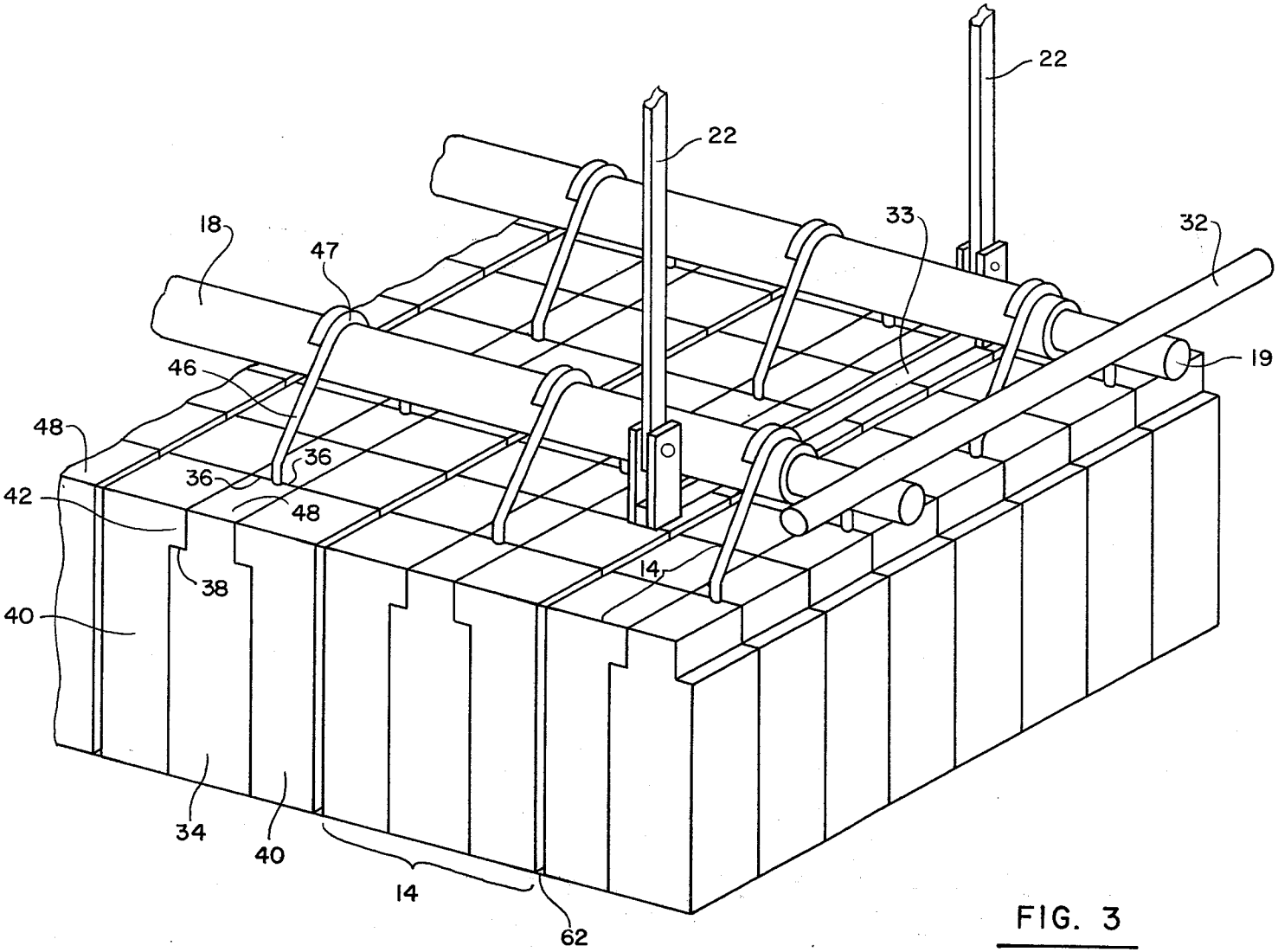
FIG. 3 is a perspective view of a portion of the roof assembly unit of FIG. 1.

Suspension tube 18, which is shown in more detail in FIG. 3, may include telescoping hangers 19 on one or both ends. Telescoping hangers 19 may telescope inside of or over the outside of suspension tube 18. Suspension tubes 18 are held in substantially parallel spaced relation to each other by transverse rods 32 secured at or near opposite ends. Suspension wires or rods 22 may be secured to intermediate cross rods 33, or any other suitable means may be used to suspend roof panel 12 from cross beam 20.

Details of the roof assembly units 14 making up suspended roof panel 12 are shown in FIG. 3. Each roof assembly unit 14 includes two refractory carrier bricks 34 having a generally rectangular configuration, as shown in FIG. 4. The first side 36 of the two carrier bricks 34 are adjacent to each other. At least one of the second and fourth sides adjacent first side 36 have shoulder means 38 extending from their upper portion. FIG. 4 shows an interior carrier brick which must have a shoulder 38 extending from each the second and fourth sides. Carrier bricks having a second or fourth side at the edge of a panel 12 of roof assembly units 12 may have that side flat. The third side of the carrier brick, opposite the first side, is flat.

At least one refractory filler brick 40, shown in detail in FIG. 5, is supported by shoulder 38. Filler brick 40 has a generally rectangular configuration with supporting lug 42 extending from one face thereof for engagement with shoulder means 38.

An adjacent pair of carrier bricks 34 in assembly unit 14 is supported by hanger 44 in supporting engagement with the first sides of adjacent carrier bricks at one end and hooks over hanger tube 18 by hook 47 at the other end. One manner in which the carrier bricks 34 may be supported by the hanger is shown in FIG. 6. Each carrier brick 34 includes in its first side 30 a hanger recess 50, a well 52 and a hanger rod depression 54. Depression 54 extends from recess 50 to the top surface 48. When the carrier bricks 34 are placed together so that first sides 36 are adjacent to and in communication with each other, hanger recesses 50, wells 52 and hanger rod depressions 54 also oppose and face each other. Hanger 44 has opposing refractory engaging brackets 56 which are adapted to fit the hanger recesses 50, hanger rod hole 58 for hanger rod 46, and locking end engaging means 60, which, when engaged with locking means 45 on hanger rod 46 prevents rotation of hanger rod 46 with respect to the hanger brackets 56 when engaged and permits such rotation when locking means 44 is disengaged. Any suitable hanger capable of suspending carrier bricks 34 in desired relation may be used in the roof assembly units of this invention.

The top surfaces 48 of carrier bricks 34 and filler bricks 40 lie in a substantially flat, common plane, as shown in FIG. 3.

It is shown in FIG. 3 that each roof assembly unit 14 includes two carrier bricks 34, and may include two or four filler bricks 40, depending upon whether the assembly unit is an edge unit along an edge transverse to the hanger tubes or an edge unit along the edge parallel to the hanger tubes, or an interior unit. Thus, up to six bricks may be supported by a single hanger rod 46 in each roof assembly unit 14. The flat top surface 48 and reduced number of hanger rods 46 provide a cold face surface of the furnace which is easy to clean.

Panel module 12 of multiple roof assembly units may be constructed by securing a plurality of assembly units 14 to hanger tubes 18 and separating some or all of the filler bricks 40 of adjacent assembly units 14 with pack expansion material 62, as shown in FIGS. 1 and 2. The panel module may be secured together with one or more strapping bands 64. Pack expansion material 62 may be alumina silica felt, or any other suitable material. The panels may be fabricated to a wide variety of sizes and shapes as most advantageous to specific furnace design requirements. The panels may be completely fabricated away from the furnace and the completed panel transported to the furnace site and installed by lowering through the structural support fraome of the furnace roof. The suspended roof construction of this invention may be installed and repaired from the cold side of the furnace by lowering or lifting panels of pre-assembled bricks between the structural support frame of the furnace. Repairs may be quickly effected to a section of furnace roof by replacing entire panel modules. When hanger tube 18 is spaced from the cold face a distance greater than the cold to hot face dimension of the rfractory, it is possible to replace assembly units 14 from the cold side of the furnace roof.

This invention provides a new carrier brick design which permits a single hanger to suspend two carrier bricks which in turn support four filler bricks, for a total of six refractory bricks, and provide a substantially flat top or cold face. Such assemblies of refractory bricks may be readily assembled into panel units of a wide variety of sizes. The panel unit of this invention provides telescoping tubes on at least one end of hanger tubes for suspension of end bricks between adjacent panel modules. The panel units may thus be lowered into place between the structural frame of the furnace roof, the telescoping tubes extended and filler bricks hung from cross bars at each end to fill the spaces between adjacent panels, corresponding to the width of the structural framework beams. An easily fabricated, easily maintained and easily repaired suspended roof construction is provided for high temperature furnaces according to this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In suspended roof construction for high temperature furnaces having a plurality of roof panel modules suspended from a structural support frame, each said panel module comprising: at least two spaced hanger tubes extending the length of one dimension of said panel module; a plurality of roof assembly units independently suspended from said hanger tubes, each said roof assembly units comprising; two refractory carrier bricks of a generally rectangular configuration, each of said carrier bricks having a first and a third opposing side and a second and fourth opposing side, said first side having a blind hanger recess extending into said brick for a portion of its thickness for engagement with a hanger capable of suspending said carrier bricks, said first side of one of said carrier bricks adjacent to and in communication with said first side of the second said carrier brick, said carrier bricks further comprising shoulder means extending from the upper portion of at least one of said second and fourth sides; at least one refractory filler brick having a generally rectangular configuration and a supporting lug on the upper portion of one side thereof engaged with said shoulder means, the entire top surfaces of said carrier bricks and said filler bricks being in a substantially flat, common plane; and a hanger in engagement with said hanger recesses of said carrier bricks at one end and in engagement with one of said hanger tubes at the other end.

2. The panel module of claim 1 wherein said hanger tubes have a cross bar fixed to said hanger tubes at one end and telescoping tubes with a cross bar fixed to the outer ends thereof, said telescoping tubes in sliding engagement with said hanger tubes at the other end, said cross bars at each end providing suspension for end bricks between adjacent panel modules.

3. The panel module of claim 1 wherein said hanger tubes are suspended from a hanger beam which is supported by said structural support frame.

4. The panel module of claim 1 wherein said roof assembly units are secured together in said module by strapping bands.

5. The panel module of claim 1 wherein said filler bricks of adjacent roof assembly units have pack expansion material therebetween.

6. The panel module of claim 1 wherein said hanger tubes have at each end telescoping tubes with a cross bar fixed to the outer ends thereof in sliding engagement with said hanger tubes, said cross bars at each end providing suspension for end bricks between adjacent panel modules.

7. The panel module of claim 1 wherein said two carrier bricks support four of said filler bricks except along the edges at right angles to said hanger tubes.

8. The panel assembly of claim 1 wherein said hanger has opposing refractory engaging projections adapted to fit said hanger recesses.

9. In suspended roof construction for high temperature furnaces, a plurality of roof assembly units, each said roof assembly units comprising:

two refractory carrier bricks of a generally rectangular configuration, each of said carrier bricks having a first and a third opposing side and a second and fourth opposing side, said first side having a blind hanger recess extending into said brick for a portion of its thickness for engagement with a hanger capable of suspending said carrier bricks, said first side of one of said carrier bricks adjacent to and in communication with said first side of the second said carrier brick, said carrier bricks further comprising shoulder means extending from the upper portion of at least one of said second and fourth sides; at least one refractory filler brick having a generally rectangular configuration and a supporting lug on the upper portion of one face thereof engaged with said shoulder means, the entire top surfaces of said carrier bricks and said filler bricks being in a substantially flat, common plane; and a hanger in engagement with said hanger recesses of said adjacent carrier bricks.

10. The roof assembly of claim 9 wherein said two carrier bricks support four of said filler bricks.

11. The roof assembly unit of claim 9 wherein said hanger has opposing refractory engaging projections adapted to fit said hanger recesses.

12. A suspended roof construction for a high temperature furnace comprising:

a structural support frame; at least one panel module comprising a plurality of independently suspended roof assembly units, said panel module(s) suspended from said support frame by suspension means;

each of said roof assembly units comprising two refractory carrier bricks of a generally rectangular configuration, each of said carrier bricks having a first and a third opposing side and a second and fourth opposing side, said first side of one of said carrier bricks adjacent to and in communication with said first side of the second said carrier brick, said first sides having blind hanger recesses extending into said bricks for a portion of their thickness for engagement with a hanger capable of suspending said carrier bricks, said carrier bricks further comprising shoulder means extending from the upper portion of at least one of said second and fourth sides; at least one refractory filler brick having a generally rectangular configuration and a supporting lug on the upper portion of one side thereof engaged with said shoulder means, the entire top surfaces of said carrier bricks and said filler bricks being in a substantially flat, common plane; a hanger in engagement with said first sides of said carrier bricks and capable of suspending said carrier bricks; and at least two spaced hanger tubes extending the length of one dimension of said panel assembly and having said hangers depending therefrom, said hanger tubes suspended from said support frame by said suspension means.

13. The suspended roof construction of claim 12 werein said hanger tubes have a cross bar fixed to said hanger tubes at one end and telescoping tubes with a cross bar fixed to the outer ends thereof, said telescoping tubes in sliding engagement with said hanger tubes at the other end, said cross bars at each end having suspended therefrom end bricks between adjacent panel modules.

14. The suspended roof construction of claim 12 wherein said hanger tubes have at each end telescoping tubes with a cross bar fixed to the outer ends thereof in sliding engagement with said hanger tubes, said cross bars at each end having suspended therefrom end bricks between adjacent panel modules.

15. The suspended roof construction of claim 12 wherein said hanger tubes are suspended from a hanger beam which is supported by said structural support frame.

16. The suspended roof construction of claim 12 wherein said roof assembly units are secured together in said panel modules by strapping bands.

17. The suspended roof construction of claim 12 wherein said filler bricks of adjacent roof assembly units have pack expansion material therebetween.

18. The suspended roof construction of claim 12 wherein said two carrier bricks support four of said filler bricks except along the edges of said panel module at right angles to said hanger tubes.

19. The suspended roof construction of claim 12 wherein said hangers have opposing refractory engaging projections adapted to fit said hanger recesses.

* * * * *